United States Patent [19]

Morito

[11] 4,311,538

[45] Jan. 19, 1982

[54] METHOD OF SEALING AN INNER COVER ARRANGED IN A BOX ANNEALING FURNACE USED FOR PRODUCING GRAIN-ORIENTED SILICON STEEL SHEETS

[75] Inventor: Nobuyuki Morito, Kobe, Japan

[73] Assignee: Kawasaki Steel Corporation, Kobe, Japan

[21] Appl. No.: 166,313

[22] Filed: Jul. 7, 1980

[30] Foreign Application Priority Data

Jul. 11, 1979 [JP] Japan ..... 54/87598

[51] Int. Cl.[3] ..... H01F 1/04

[52] U.S. Cl. ..... 148/112; 148/110; 148/111

[58] Field of Search ..... 266/44; 148/110-113

[56] References Cited

U.S. PATENT DOCUMENTS

| | | | |
|---|---|---|---|
| 4,190,469 | 2/1980 | Ichida et al. | 148/113 |
| 4,202,711 | 5/1980 | Littman et al. | 148/113 |
| 4,207,123 | 6/1980 | Reynolds et al. | 148/113 |

OTHER PUBLICATIONS

*The Condensed Chemical Dictionary*, 8th Ed., Von Nostrand Reinhold Co., pp. 598 and 957, 1971.

*The Making Shaping and Treating of Steel*, United States Steel, 8th Ed., 1964, pp. 1063-1064.

*Primary Examiner*—L. Dewayne Rutledge
*Assistant Examiner*—John P. Sheehan
*Attorney, Agent, or Firm*—Balogh, Osann, Kramer, Dvorak, Genova & Traub

[57] ABSTRACT

The use of coarse sand particles having an average size of 0.5-10 mm in the sealing of the lower end portion of an inner cover, which is arranged in a box annealing furnace, at the final annealing, in the production of grain-oriented silicon steel sheets, can maintain the interior of the inner cover at a low dew point atmosphere. It can also substantially prevent the exfoliation of forsterite insulating film from the coiled steel sheet surface at the upper and lower edge portions of the coiled steel sheet.

3 Claims, 6 Drawing Figures

METHOD OF SEALING AN INNER COVER ARRANGED IN A BOX ANNEALING FURNACE USED FOR PRODUCING GRAIN-ORIENTED SILICON STEEL SHEETS

The present invention relates to a method of sealing an inner cover arranged in a box annealing furnace, which is used for producing grain-oriented silicon steel sheets, at the final annealing of a primarily annealed steel sheet.

Grain-oriented silicon steel sheets are generally produced through the following steps. That is, a silicon steel ingot containing not more than 4.0% by weight (hereinafter, % means % by weight) of Si is hot rolled, the hot rolled sheet is annealed, the annealed sheet is subjected to one cold rolling or two or more cold rollings with an intermediate annealing between the cold rollings to produce a cold rolled sheet having a final gauge, the cold rolled sheet is subjected to a primary recrystallization annealing to develop primarily recrystallized grains and at the same time to remove carbon, and the primarily annealed steel sheet is subjected to a final annealing to develop secondarily recrystallized grains oriented in (110)[001] directon and at the same time to remove harmful impurities and to form a forsterite insulating film on the steel sheet surface.

The above described final annealing is generally carried out in a box furnace having an inner cover and an outer cover. The inner cover is arranged in order to heat uniformly the interior of the furnace and to replace easily the gas in the furnace. The present invention relates to an improvement of the sealing method of the inner cover.

For a better understanding of the invention, reference is taken to the accompanying drawings, wherein.

Figure 1:
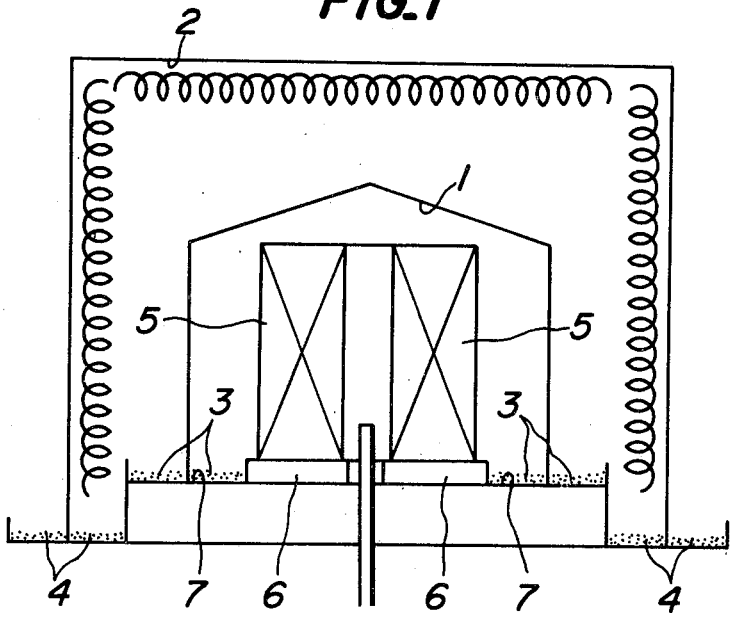
FIG. 1 is a diagrammatic view of a box annealing furnace.

In the production of grain-oriented silicon steel sheets, the final annealing is generally carried out in a box furnace (tight coil annealing furnace) having an inner cover 1 and an outer cover 2 as shown in FIG. 1. The inner cover 1 is arranged in order to heat uniformly the interior of the furnace and to replace easily the gas in the furnace. As the seal 3 for the inner cover 1, sand seal, such as zircon sand seal or the like, has hitherto been used, and as the seal 4 for the outer seal 2, sand seal, oil seal or water seal has hitherto been used.

The final annealing for the production of grain-oriented silicon steel sheets is different from the box annealing for the production of ordinary cold rolled thin steel sheets in the following points. In the production of grain-oriented silicon steel sheets, an annealing separator consisting mainly of MgO is applied to the surface of a silicon steel sheet, and the steel sheet is annealed at a high temperature to form a forsterite insulating film.

However, when the final annealing temperature for a decarburized (primarily annealed) sheet having an annealing separator coated thereon reaches 400°–600° C., the separator is decomposed to liberate the hydrated water to form an annealing atmosphere having a high dew point in the inner cover 1. While, when the decarburized (primarily annealed) sheet having an annealing separator coated thereon is finally annealed under a hydrogen atmosphere, iron oxide accumulated in the sheet during the decarburization annealing and iron oxide accumulated in the sheet due to the oxidation by steam liberated from the annealing separator at the beginning of the final annealing are reduced by $H_2$ to form an annealing atmosphere having a high dew point in the inner cover 1 as well. When the interior of an inner cover 1 is exposed to a high dew point atmosphere for a long period of time, the upper and lower edges of the coil 5, which are in direct contact with the annealing atmosphere, are excessively oxidized to deteriorate its mechanical property, and the forsterite film formed at the upper and lower edges of the coil 5 in the outermost turn is exfoliated. When such phenomena occur, the yield of the aimed grain-oriented silicon steel sheets is lowered, and therefore it is important to prevent the exfoliation of the forsterite film at the coil edge, and it is necessary that the interior of the inner cover is kept to an atmosphere having a dew point as low as possible in order to prevent the exfoliation of the film.

Figure 2:
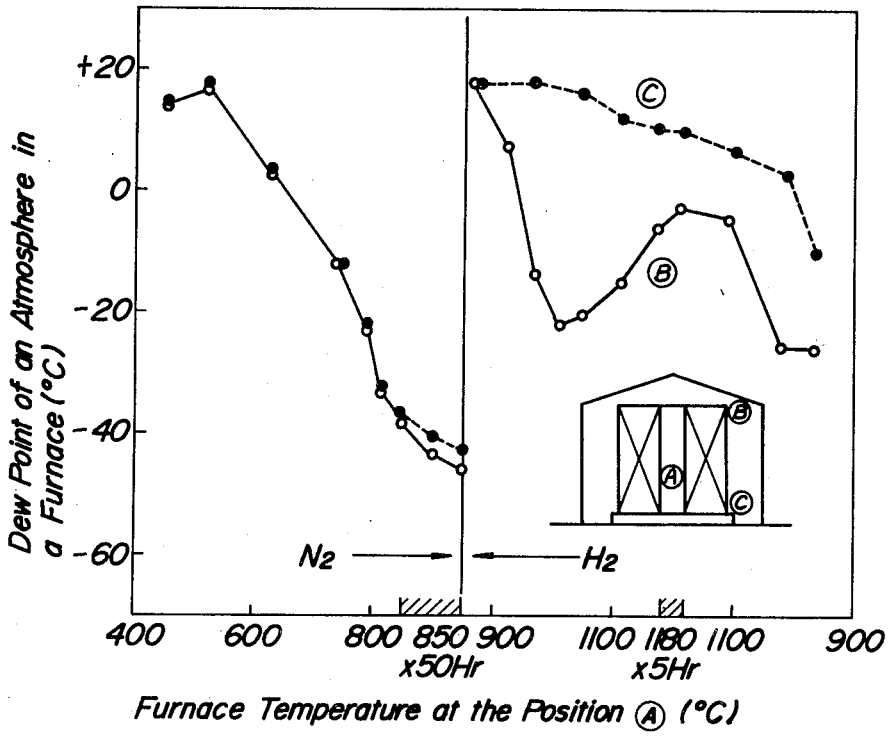
FIG. 2 is a graph illustrating a variation of dew point of the atmosphere in an inner cover of a conventional zircon sand seal method.

When a coil 5 of a primarily annealed steel sheet coated with an annealing separator consisting mainly of MgO was finally annealed in a box annealing furnace, which was provided with an inner cover sealed with zircon sand having a particle size of about 100 meshes, to produce a grain-oriented silicon steel sheet, the dew point of the annealing atmosphere varied as shown in FIG. 2. It can be seen from FIG. 2 that the dew point at the vicinity of the lower edge of the coil 5 is higher than that at the vicinity of the upper edge of the coil 5, and this high dew point is kept for a very long period of time at high temperature. In this case, the insulating film was exfoliated at the upper and lower edges of the coil in a width of more than 20 mm, and the exfoliated film portion extends over about 200 m at the lower edge of the outermost turn of the coil 5 and over about 50 m at the upper edge thereof. Since the dew point of the atmosphere in the furnace is distributed such that the dew point at the upper portion in the furnace is lower than that at the lower portion therein, when the coil 5 is mounted on a supporter 6 having a large height, the relatively high dew point of atmosphere at the lower edge portion of the coil 5 lowers, and the exfoliation of film at the coil edge decreases. However, a large scale installation must be used and the installation cost is high. Moreover, the interior of the inner cover 1 is not substantially formed into a low dew point atmosphere, and therefore the film is apt to be easily exfoliated due to slight change of condition.

The inventors have variably investigated the sand seal in these conventional technics, and found out a novel method for keeping the interior of the inner cover at a low dew point atmosphere. That is, the newly found out method is based on the discovery of the following two requirements.

Figure 3:
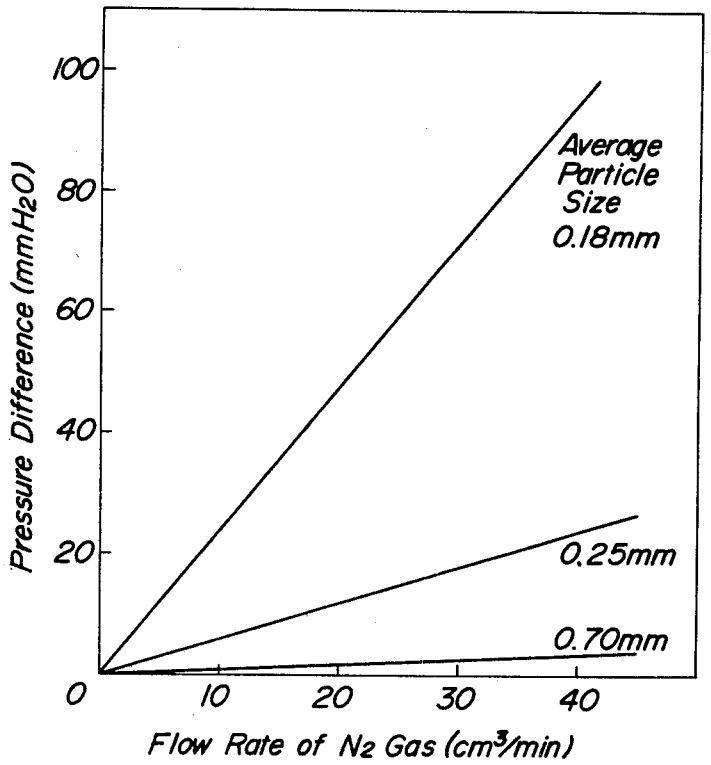
FIG. 3 is a graph illustrating the influence of the particle size of powders formed into a packed layer upon the flow resistance of $N_2$ gas.

One of the requirements is that it is important to flow uniformly gas in the surroundings of a coil in order to obtain a low dew point atmosphere. That is, in the conventional sand seal, the furnace pressure reaches a value as high as from several tens mm to one hundred mm of water column due to the use of finely divided sand powders. Therefore, when a weak sealing portion is locally formed in the sand seal, the seal is broken at the weak sealing portion due to the high furnace pressure, and the gas streams are concentrated at the broken portion of seal. As a result, gas streams are stagnated in the portions other than the broken portion of seal, and a high dew point atmosphere is maintained for a long period of time as illustrated in FIG. 2. In the conventional method, in order to prevent such non-uniform filling strength of the sealing material, a seal is made of particles having a smaller size or a sealng layer having a large depth is formed. However, uniform filling strength has not yet been obtained. In the present invention, the non-uniform filling strength is considered to be an unavoidable phenomenon, and the problem due to this non-uniform filling strength has been solved by decreasing the flow resistance of gas to a very low value which is not influenced by the non-uniform filling strength. In order to decrease the flow resistance of gas, it is necessary to decrease the flow rate of gas or to increase the void volume of sealing layer. However, when the flow rate of gas is low, steam generated in the inner cover can not be sufficiently exhausted. As the results, the inventors have found out that the use of a sealing layer having a large void volume, that is, the use of coarse particles as a sealing material, can form a uniform gas stream. FIG. 3 illustrates the influence of the particle size of powders upon the flow resistance of gas. It can be seen from FIG. 3 that powders having a particle size of at least 0.5 mm have substantially no influence upon the flow resistance of gas. In fact, when a sealing layer was formed by the use of coarse particles having a size of at least 0.5 mm, uniform gas stream was obtained in the surrounding of the coil.

Another requirement for obtaining a low dew point atmosphere is that the sealing layer is not impervious or selective to the passing of gas therethrough. As illustrated in FIG. 2, when a zircon sand seal having a particle size of about 100 meshes is used, nitrogen atmosphere has substantially the same dew point at the upper and lower edge portions of a coil, but hydrogen atmosphere has a remarkably higher dew point at the lower edge portion of a coil than that at the upper edge portion of the coil. The inventors believed that such dew point distribution has occurred due to the difference of flowabilities of gases through the sealing layer. It is known that the flow resistance of gas through a packed layer is influenced by the viscosity of the gas. Viscosities of nitrogen, steam and hydrogen decrease in the order of $N_2 > H_2O > H_2$, and therefore the flowabilities of these gases through the packed layer decrease in the order of $H_2 > H_2O > N_2$. That is, $H_2O$ can pass easily through a sealing layer under $N_2$ atmosphere, but is difficult to pass through a sealing layer under $H_2$ atmosphere. From this phenomenon, the above described dew point distribution can be understood. However, the use of a sealing layer having a high void volume can eliminate the above described limitation (selectivity or imperviousness) due to the kind of gases.

As described above, it has been found from both the above described requirements that it is necessary to use a sealing layer having a high void volume, that is, to use coarse particles as the sealing material, in order to keep the interior of the inner cover at a low dew point atmosphere.

In conventional methods, wherein zircon sand having a particle size of about 100 meshes is used in the sealing of an inner cover (See FIG. 2), hydrogen atmosphere has a high dew point of 10°-20° C. at the lower edge portion of the coil (shown by portion C in FIG. 2) at high temperatures. However, in the present invention, wherein Mullite small globes having a particle size of 3 mm are used in the sealing of the inner cover (See FIG. 4), hydrogen atmosphere has a very low dew point of about −30° C. in the lower edge portion of the coil (shown by portion C in FIG. 4), which is substantially the same as the dew point in the upper edge portion of the coil (shown by portion B in FIG. 4), at high temperatures.

Figure 5A:
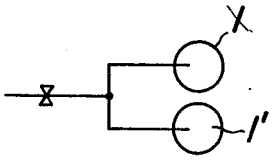
FIGS. 5*a* and 5*b* are diagrammatic views illustrating the gas piping systems for inner cover.
Figure 5B:
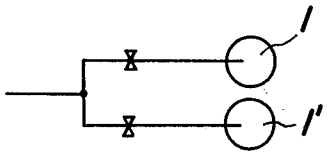

When a sealing layer formed of coarse particles is used in a multiple type annealing furnace, gas can be flowed into each inner cover 1 in substantially the same flow rate, and therefore the amount of gas to be flown into each inner cover 1 can be easily controlled. That is, the convenional sand seal is always non-uniform and breaks accidentally during annealing, and therefore when the conventional sand seal is used in a gas piping system shown in FIG. 5*a*, scattering of the amounts of gases flowed into the inner covers 1 is large. For example, when it is intended to flow gas into two inner covers 1 and 1' at a rate of 4 $Nm^3/hr$ in total, it is seldom that gas is flowed into each of the inner covers 1 and 1' in an equal amount of 2 $Nm^3/hr$. In general, 0–1.5 $Nm^3/hr$ of gas is flowed into one inner cover, and 4–2.5 $Nm^3/hr$ of gas is flowed into another inner cover. On the contrary, when a sealing layer formed of coarse particles according to the present invention is used, the furnace pressures in inner covers 1 are substantially same with each other. Therefore, when gas is flowed into two inner covers 1 and 1' at a rate of 4 $Nm^3/hr$ in total, 1.5–2 $Nm^3/hr$ of gas is flowed into one inner cover and 2.5–2 $Nm^3/hr$ of gas is flowed into another inner cover, and scattering of the amounts of gases flowed into both the inner covers 1 and 1' is very small. In general, when one coil is annealed in one inner cover, it is necessary to use gas in an amount of at least 0.5 $Nm^3/hr$ per one inner cover in order to obtain a good film property in the finally annealed grain-oriented silicon steel sheet. In the conventional seal, a large number of flow meters are arranged by the use of the piping system shown in FIG. 5*b*, or a large amount of gas is flowed by the use of the piping system shown in FIG. 5*a*. However, in spite of such arrangements, the film is always exfoliated at the lower edge of coil in the conventional seal. However, when the sealing material of the present invention is used, scattering of the amounts of gases flowed into the inner covers is small, and therefore even when gas is flowed at a very low flow rate of 0.5 $Nm^3/hr$ per one inner cover, a good film property can be obtained.

As described above, the novelty of the present invention lies in a method of sealing the lower end portion of an inner cover arranged in a box annealing furnace, at the final annealing carried out for forming a forsterite insulating film on the surface of a primarily annealed steel sheet in the production of a grain-oriented silicon steel sheet. The improvement resides in sealing the lower end portion of the inner cover with stacked coarse sand particles, for example, stacked coarse zircon sand particles having an average size of 0.5–10 mm.

The particle size, shape and stacked state of the particles to be used in the present invention will be explained hereinafter.

The average size of the particles to be used in the present invention should be 0.5–10 mm. When fine particles having a size of less than 0.5 mm are used, the furnace pressure becomes high, and the seal is locally broken. While, when coarse particles having a size of more than 10 mm are used, the insertion of the inner cover 1 is troublesome, and further a large amount of voids are formed to make the furnace pressure zero, and hence back-flow of air may occur. Based on the above described reason, the average particle size should be 0.5–10 mm and is preferably 1–5 mm.

The shape of the particles is preferably globular. The closer a particle's shape resembles a globe, the more complete a sealing can be obtained. The reason is that, since a sealing layer formed of globular particles moves in correspondence with the movement of the wall suface of an inner cover 1 due to its expansion and shrinkage during the annealing, a stable seal can be always secured. Therefore, sinterable particles or rectangular particles are not highly desired or preferred. When these particles are used, the shape of the sealing layer is apt to be fixed, and the seal is incomplete. While, when coarse globular particles are used, the inner cover can be easily inserted into the sealing layer, and therefore the operability at the insertion of an inner cover into the sealing layer is remarkably superior to the operability at the insertion of an inner cover into a conventional sealing layer formed of finely divided sand particles or rectangular coarse particles.

Moreover, it is necessary to form gaps having a width of at least 0.5 mm between a base plate 7 and the base of the inner cover 1 as shown in FIG. 1 over the entire circumference of the inner cover. When the base of an inner cover 1 is tightly adhered to the base plate 7, the flow resistance of gas at the base of the inner cover is larger than that in the interior of the sealing layer similarly to the case of seal by the use of finely divided particles, and a local gas stream is formed. Even when a gap having an excessively large width is formed, problems do not occur. Of course, the gap must be embedded in the sealing layer.

The present invention will now be explained with respect to experimental data in a commercial scale furnace.

Figure 4:
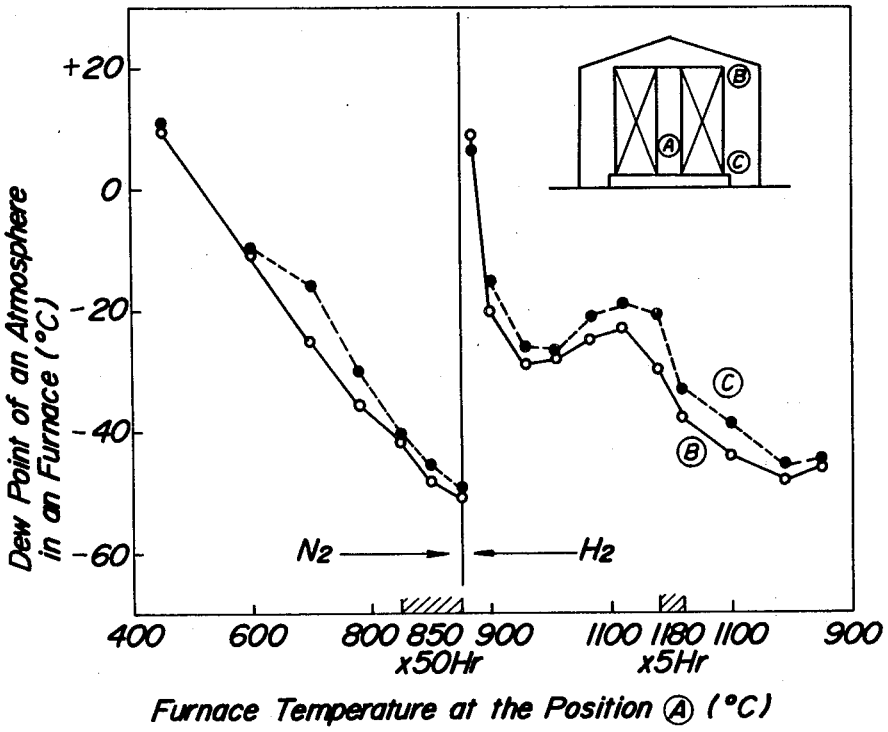
FIG. 4 is a graph illustrating a variation of dew point of the atmosphere in an inner cover sealed with small globes having a diameter of 3 mm according to the present invention.

A silicon steel ingot was hot rolled into a thickness of 3 mm, the hot rolled sheet was annealed at 950° C. for 5 minutes, and the annealed sheet was subjected to two cold rollings with an intermediate annealing at 900° C. for 3 minutes between the cold rollings to obtain a cold rolled sheet having a final gauge of 0.3 mm. The cold rolled sheet was subjected to a decarburization annealing at 820° C. for 3 minutes in wet hydrogen. The decarburized steel sheet was applied with MgO as an annealing separator, and then subjected to a final annealing, wherein the sheet was firstly kept at 850° C. for 50 hours in nitrogen and then kept at 1,180° C. for 5 hours in hydrogen. In this final annealing, mullite small globes having a diameter of 3 mm were used as a sealing material for inner cover, and a beam was arranged at a height of 1 cm above a base plate 7. The variation of the dew point in the inner cover during the above described final annealing is shown in FIG. 4. As a result of the above experiment, the exfoliation of the insulating film at the edge of the coil in a width of more than 20 mm was observed at the lower edge of the coil over a very small length of about 5 cm, and was not observed at all at the upper edge thereof. The dew point in the above experiment is remarkably lower than that in the conventional method shown in FIG. 2, wherein zircon sand seal having a particle size of about 100 meshes is used, and moreover the exfoliated length of the film at the coil edge in the above described experiment is remarkably smaller than that in the conventional method shown in FIG. 2.

The following examples are given for the purpose of illustration of this invention and are not intended as limitations thereof.

EXAMPLE 1

A silicon steel ingot containing 0.03% of C, 3.10% of Si, 0.06% of Mn and 0.02% of S was hot rolled into a thickness of 3 mm, the hot rolled sheet was annealed at 950° C. for 5 minutes, and the annealed sheet was subjected to two cold rollings with an intermediate annealing at 900° C. for 3 minutes between the cold rollings to obtain a cold rolled sheet having a final gauge of 0.3 mm. The cold rolled sheet was subjected to a decarburization annealing at 820° C. for 3 minutes in wet hydrogen. The decarburized steel sheet was applied with MgO as an annealing separator, and then subjected to a final annealing, wherein the sheet was firstly kept at 850° C. for 50 hours in nitrogen and then kept at 1,180° C. for 5 hours in hydrogen. In the final annealing, mullite small globes having particle sizes ranging from 1 mm to 2 mm and an average particle size of 1.5 mm were used as a sealing material for the inner cover, and a gap having a width of 5 mm was formed between the base of the inner cover and the base plate 7. The exfoliation of the film in the above treated coiled sheet at the outermost turn was examined. The results are shown in the following Table 1 together with the exfoliation of the film in the following Comparative example 1.

COMPARATIVE EXAMPLE 1

The same treatment as described in Example 1 was carried out, except that zircon sands having a particle size of 80–100 meshes were used as a sealing material for inner cover. The obtained results are shown in Table 1.

TABLE 1

| Outermost turn of coil | Exfoliated length of film at the lower edge of coil | | Exfoliated length of film at the upper edge of coil | |
|---|---|---|---|---|
| Exfoliated width of film | at least 2 cm | at least 1 cm | at least 2 cm | at least 1 cm |
| Present invention | 0 m | 10 m | 0 m | 0 m |
| Comparative example | 300 m | 400 m | 50 m | 100 m |

As described above, according to the present invention, exfoliation of insulating film at the upper and lower edges of coil is very small, that is, the yield of the formation of insulating film is remarkably high.

What is claimed is:

1. In a method of producing grain-oriented silicon steel sheets, said method being of the type including the steps of placing a decarburized steel sheet, prior to final annealing, in an inner cover arranged in a box annealing furnace, sealing the bottom edge of the inner cover and subjecting the decarburized steel sheet to a final annealing, carrying out a secondary recrystallization annealing and a purification annealing while forming at the same time, an electrically insulating film on the surface of the steel sheet, the improvement which comprises, prior to final annealing, sealing the lower end of the inner cover with coarse sand particles having an average size of 0.5–10 mm so as to effect a substantial reduction in the exfoliation of the insulating film formed at the final annealing on the surface of the steel sheet.

2. A method according to claim 1, wherein said sand particles are zircon sand particles or mullite particles.

3. A method according to claim 1, wherein said sand particles have a globular shape.

* * * * *